US011339017B2

(12) United States Patent
Niwa

(10) Patent No.: US 11,339,017 B2
(45) Date of Patent: May 24, 2022

(54) RECORDING-MATERIAL-TRANSPORTING DEVICE AND IMAGE FORMING APPARATUS

(71) Applicant: FUJIFILM Business Innovation Corp., Tokyo (JP)

(72) Inventor: Masahito Niwa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/920,398

(22) Filed: Jul. 2, 2020

(65) Prior Publication Data

US 2021/0237993 A1 Aug. 5, 2021

(30) Foreign Application Priority Data

Feb. 3, 2020 (JP) ..... JP2020-016150

(51) Int. Cl.

| | |
|---|---|
| ***B65H 3/48*** | (2006.01) |
| ***B65H 3/08*** | (2006.01) |
| ***B65H 5/06*** | (2006.01) |
| ***G03G 15/00*** | (2006.01) |

(52) U.S. Cl.

CPC ..... *B65H 3/48* (2013.01); *B65H 3/0833* (2013.01); *B65H 5/062* (2013.01); *G03G 15/6511* (2013.01); *G03G 15/6558* (2013.01); *G03G 2215/004* (2013.01); *G03G 2215/00396* (2013.01)

(58) Field of Classification Search

CPC ..... B65H 3/047; B65H 3/0833; B65H 3/128; B65H 3/48; B65H 2406/10; B65H 2406/11; B65H 2406/12; B65H 2406/121; B65H 2406/1211; B65H 2406/122

See application file for complete search history.

(56) References Cited

U.S. PATENT DOCUMENTS

| | | | | |
|---|---|---|---|---|
| 5,328,165 | A * | 7/1994 | Martin | B65H 3/128 271/98 |
| 6,398,207 | B1 | 6/2002 | Taylor et al. | |
| 2003/0230843 | A1* | 12/2003 | Clark | B65H 3/48 271/90 |
| 2019/0241381 | A1* | 8/2019 | Furuichi | B65H 3/128 |
| 2021/0171300 | A1* | 6/2021 | Niwa | B65H 3/08 |

FOREIGN PATENT DOCUMENTS

| | | |
|---|---|---|
| JP | 2002019978 | 1/2002 |

* cited by examiner

*Primary Examiner* — Prasad V Gokhale
(74) *Attorney, Agent, or Firm* — JCIPRNET

(57) ABSTRACT

A recording-material-transporting device includes an attracting part to which a recording material is attracted from below, and a blowing device that blows air from a position higher than the attracting part to an edge of the recording material attracted to the attracting part.

17 Claims, 10 Drawing Sheets

RECORDING-MATERIAL-TRANSPORTING DEVICE AND IMAGE FORMING APPARATUS

CROSS-REFERENCE TO RELATED APPLICATIONS

This application is based on and claims priority under 35 USC 119 from Japanese Patent Application No. 2020-016150 filed Feb. 3, 2020.

BACKGROUND

(i) Technical Field

The present disclosure relates to a recording-material-transporting device and an image forming apparatus.

(ii) Related Art

A sheet feeding device disclosed by Japanese Unexamined Patent Application Publication No. 2002-19978 includes an air sending device that generates a vacuum pressure in an air plenum so that a sheet included in a sheet stack is suctioned and is brought into contact with the air plenum and with a sealing mechanism.

SUMMARY

In one of techniques of transporting a recording material, a topmost one of recording materials that are stacked is attracted to an attracting part, whereby one recording material is picked up.

In such a technique, for example, if the recording materials are sticking together with a large force, some recording materials below the topmost recording material may stick to the topmost recording material. Consequently, plural recording materials may be attracted to the attracting part.

To suppress the attraction of plural recording materials, air may be blown to the recording materials from lateral sides of the recording materials. However, if air is blown from the lateral sides, the recording materials may be lifted up, failing to separate the plural recording materials sticking together from one another.

Aspects of non-limiting embodiments of the present disclosure relate to reducing the probability that plural recording materials may be attracted to an attracting part, compared with a case where air is blown to the recording materials only from lateral sides of the recording materials.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a recording-material-transporting device including an attracting part to which a recording material is attracted from below, and a blowing device that blows air from a position higher than the attracting part to an edge of the recording material attracted to the attracting part.

BRIEF DESCRIPTION OF THE DRAWINGS

Exemplary embodiments of the present disclosure will be described in detail based on the following figures, wherein.

DETAILED DESCRIPTION

Figure 1:
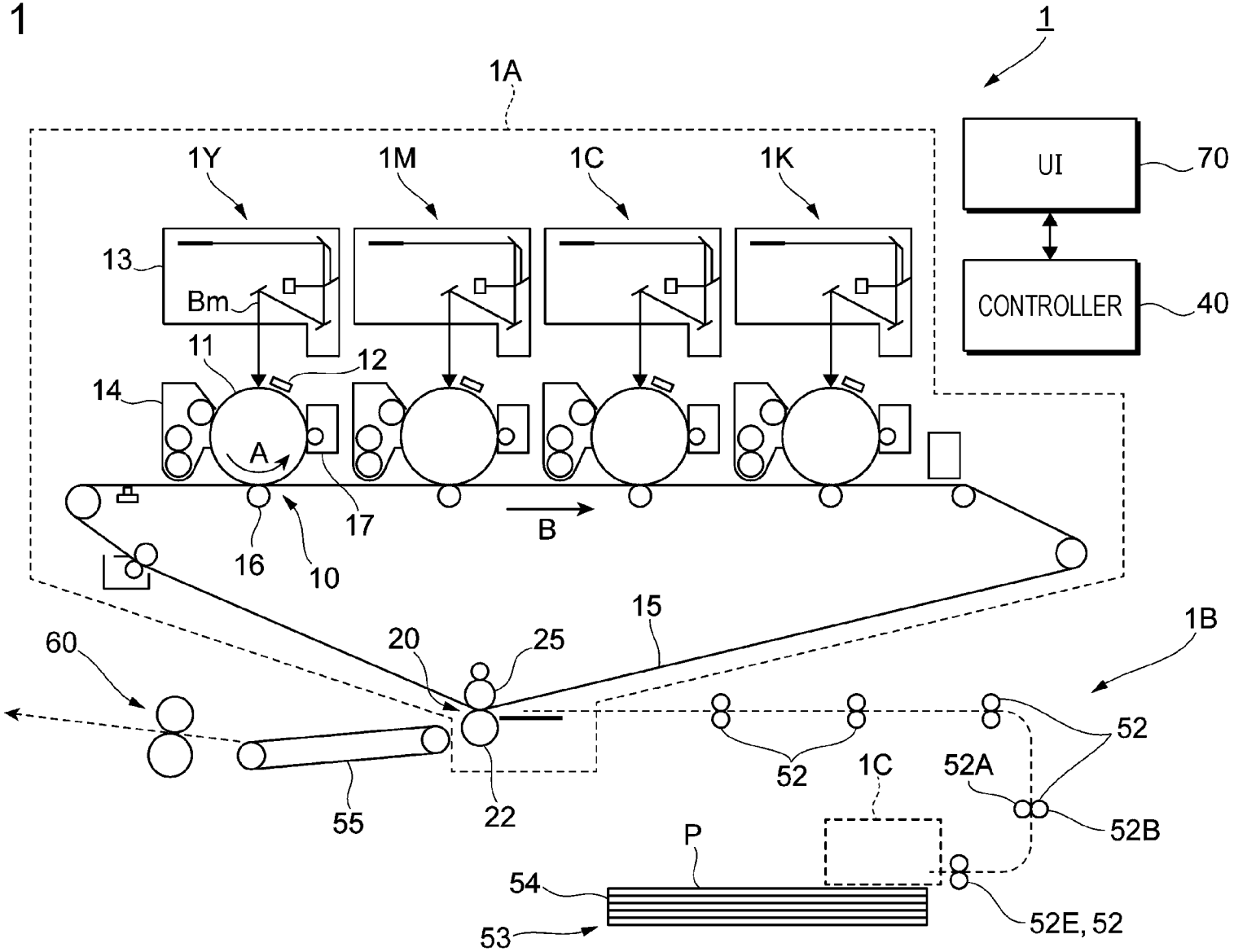
FIG. 1 is a schematic diagram of an image forming apparatus.

FIG. 1 is a schematic diagram of an image forming apparatus 1 according to an exemplary embodiment of the present disclosure.

The image forming apparatus 1 illustrated in FIG. 1 is of a so-called tandem type and employs an intermediate transfer method. The image forming apparatus 1 includes an image forming section 1A that forms an image on a sheet P, which is an exemplary recording material. The image forming apparatus 1 further includes a sheet transporting device 1B that feeds and transports sheets P one by one from a stack of sheets P placed on a sheet stacking unit 53.

The image forming section 1A, which is an exemplary image forming device, includes plural image forming units 1Y, 1M, 1C, and 1K that electrophotographically form toner images by using different color components, respectively.

The image forming section 1A further includes first transfer parts 10 where the toner images formed by the image forming units 1Y, 1M, 1C, and 1K with the respective color components are sequentially transferred (first-transferred) to an intermediate transfer belt 15 such that the toner images are superposed one on top of another. The image forming section 1A further includes a second transfer part 20 where the toner images superposed on the intermediate transfer belt 15 are collectively transferred (second-transferred) to a sheet P.

The image forming apparatus 1 further includes a fixing device 60 that fixes the toner images second-transferred to the sheet P.

The image forming apparatus 1 further includes a controller 40 that controls operations of relevant devices (units), and a user interface (UI) 70 including a display panel and so forth and that receives information from a user and displays information to the user.

The image forming units 1Y, 1M, 1C, and 1K each include the following.

A photoconductor drum 11 that rotates in a direction of arrow A is surrounded by a charging device 12 that charges the photoconductor drum 11, an exposure device 13 that forms an electrostatic latent image on the photoconductor drum 11, and a developing device 14 that develops the electrostatic latent image on the photoconductor drum 11 with toner.

The image forming units 1Y, 1M, 1C, and 1K each further include a first transfer roller 16, with which the toner image formed on the photoconductor drum 11 with a corresponding one of the color components is transferred to the intermediate transfer belt 15 at the first transfer part 10.

The image forming units 1Y, 1M, 1C, and 1K each further include a drum cleaner 17 that removes residual toner and the like from the photoconductor drum 11.

The intermediate transfer belt 15 rotates at a predetermined speed in a direction of arrow B illustrated in FIG. 1.

The first transfer part 10 is defined by the first transfer roller 16 provided across the intermediate transfer belt 15 from the photoconductor drum 11.

In the present exemplary embodiment, the toner images on the respective photoconductor drums 11 are sequentially electrostatically attracted to the intermediate transfer belt 15, whereby a superposition of toner images is formed on the intermediate transfer belt 15.

The second transfer part 20 is defined by a second transfer roller 22 facing the outer peripheral surface of the intermediate transfer belt 15, and a backup roller 25.

The second transfer roller 22 is pressed against the backup roller 25 with the intermediate transfer belt 15 interposed therebetween. A voltage is applied between the second transfer roller 22 and the backup roller 25, whereby the toner images are second-transferred to a sheet P transported to the second transfer part 20.

In the present exemplary embodiment, image data is outputted from an image reading device, a personal computer (PC), or the like (not illustrated) to the image forming apparatus 1.

The image data is processed by an image processing device (not illustrated) into pieces of image data generated for the four respective colors of Y, M, C, and K. The pieces of image data are outputted to the respective exposure devices 13 provided for the four respective colors of Y, M, C, and K.

The exposure devices 13 each emit exposure beam Bm from, for example, a semiconductor laser to the photoconductor drum 11 of a corresponding one of the image forming units 1Y, 1M, 1C, and 1K in accordance with a corresponding one of the pieces of image data received.

After the surfaces of the photoconductor drums 11 are charged by the charging devices 12, the surfaces are subjected to scan exposure performed by the exposure devices 13. Thus, electrostatic latent images are formed on the respective photoconductor drums 11.

Subsequently, toner images are formed on the respective photoconductor drums 11 by the respective developing devices 14 and are transferred to the intermediate transfer belt 15 at the respective first transfer parts 10, where the photoconductor drums 11 are in contact with the intermediate transfer belt 15.

The toner images thus sequentially first-transferred to the surface of the intermediate transfer belt 15 are transported to the second transfer part 20 with the rotation of the intermediate transfer belt 15.

At the second transfer part 20, the second transfer roller 22 is pressed against the backup roller 25 with the intermediate transfer belt 15 interposed therebetween. A sheet P is transported from the sheet stacking unit 53 and is nipped between the intermediate transfer belt 15 and the second transfer roller 22.

Thus, the toner images, which are yet to be fixed, on the intermediate transfer belt 15 are collectively electrostatically transferred to the sheet P at the second transfer part 20.

The sheet P having the toner images transferred thereto then passes through the fixing device 60 and is outputted to a sheet output part (not illustrated).

The transport of the sheet P from the sheet stacking unit 53 through the second transfer part 20 and the fixing device 60 to the sheet output part is performed by the sheet transporting device 1B, which is an exemplary recording-material-transporting device.

The sheet transporting device 1B includes a sheet feeding section 1C that feeds the topmost one of the sheets P stacked on the sheet stacking unit 53.

The sheet transporting device 1B further includes plural transport rollers 52 that transport the sheet P fed from the sheet feeding section 1C.

The transport rollers 52 each include a driving roller 52A that rotates by receiving a driving force from a motor (not illustrated), and a follower roller 52B that is in contact with the driving roller 52A and rotates by receiving the driving force from the driving roller 52A.

In the present exemplary embodiment, the sheet P fed from the sheet feeding section 1C is first transported by one of the plural transport rollers 52 that is positioned on the upstreammost side in the direction of transport of the sheet P (the transport roller 52 on the upstreammost side is hereinafter referred to as "upstreammost transport roller 52E").

The sheet P is further transported by the other transport rollers 52 that are positioned on the downstream side with respect to the upstreammost transport roller 52E to the second transfer part 20 and then to the fixing device 60.

The sheet transporting device 1B further includes a transport belt 55.

The transport belt 55 is provided on the downstream side with respect to the second transfer roller 22 in the direction of transport of the sheet P (hereinafter referred to as "sheet transporting direction"). The transport belt 55 transports the sheet P having undergone second transfer to the fixing device 60.

FIGS. 2A to 2D illustrate the sheet feeding section 1C. FIG. 3 is a perspective view of a suction unit 100 (to be described below) seen in a direction of arrow III illustrated in FIG. 2A.

Figure 2A:
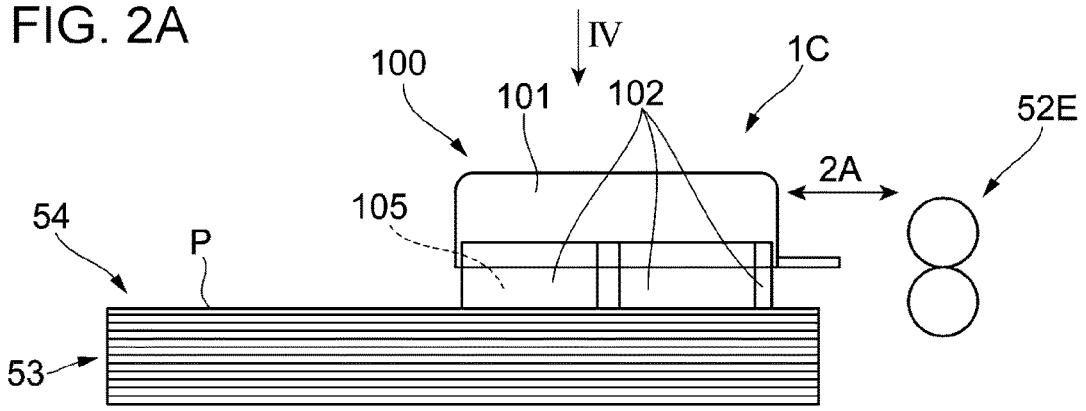
FIGS. 2A to 2D illustrate a sheet feeding section.
Figure 3:
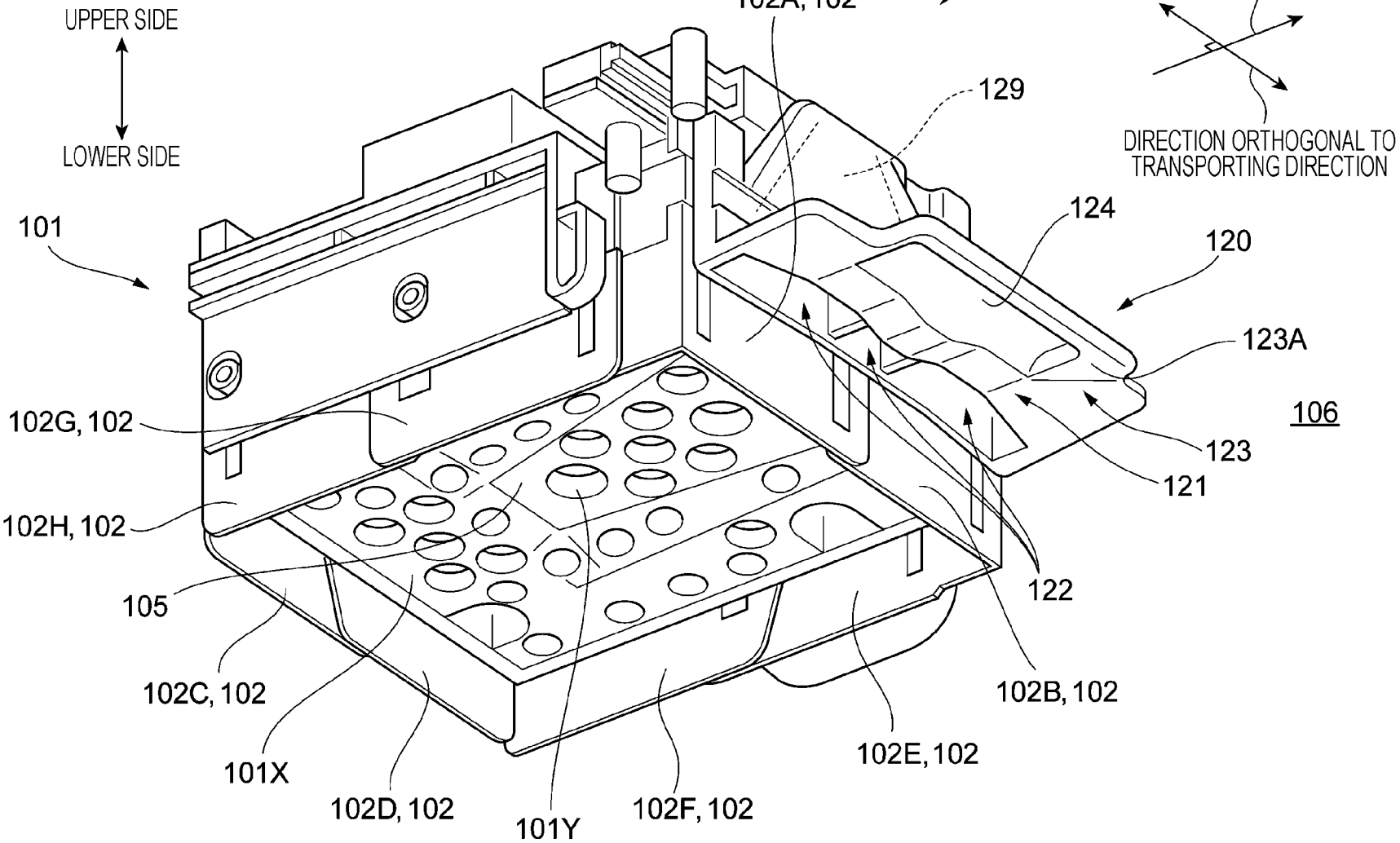
FIG. 3 is a perspective view of a suction unit seen in a direction of arrow III illustrated in FIG. 2A.

As illustrated in FIG. 2A, the sheet feeding section 1C includes the suction unit 100. The suction unit 100 suctions one of the sheets P stacked on the sheet stacking unit 53. The sheet feeding section 1C further includes a moving mechanism (not illustrated) that moves the suction unit 100 in directions represented by arrow 2A illustrated in FIG. 2A.

The moving mechanism may be a publicly known mechanism including any of a motor, a gear, a rack, a pinion, a belt drive mechanism, and so forth and is not limited to a specific mechanism.

In the present exemplary embodiment, as represented by arrow 2A, the suction unit 100 is moved by the moving mechanism in a direction toward the upstreammost transport roller 52E and in a direction away from the upstreammost transport roller 52E.

Specifically, in the present exemplary embodiment, the suction unit 100 is moved by the moving mechanism in the direction toward the upstreammost transport roller 52E from a position above a sheet stack 54. Furthermore, in the present exemplary embodiment, the suction unit 100 having been moved toward the upstreammost transport roller 52E is moved by the moving mechanism toward the sheet stack 54 to return to the position above the sheet stack 54.

As illustrated in FIG. 2A, the suction unit 100 includes a rectangular parallelepiped unit body 101, and plural movable members 102 each hanging down from the unit body 101.

The unit body 101 is provided with a suction tube (not illustrated). In the present exemplary embodiment, as to be described below, the unit body 101 suctions a sheet P.

The movable members 102 each have a plate shape and are movable up and down.

In the present exemplary embodiment, as illustrated in FIG. 3, the movable members 102 are a first leading-end movable member 102A, a second leading-end movable member 102B, a first trailing-end movable member 102C, a second trailing-end movable member 102D, a first right movable member 102E, a second right movable member 102F, a first left movable member 102G, and a second left movable member 102H.

In the present exemplary embodiment, the above eight movable members 102 separate a rectangular parallelepiped depressurization space 105 positioned below the unit body 101 from an atmospheric space 106 positioned around the depressurization space 105.

In the present exemplary embodiment, a rectangular parallelepiped space enclosed by the eight movable members 102 corresponds to the depressurization space 105. Furthermore, a space outside the depressurization space 105 corresponds to the atmospheric space 106, which is at atmospheric pressure.

More specifically, in the present exemplary embodiment, a lower surface 101X of the unit body 101 has plural holes 101Y, and air in the depressurization space 105 is suctioned through the hoes 101Y. Thus, the pressure in the depressurization space 105 is reduced to be lower than the atmospheric pressure.

In the present exemplary embodiment, when air in the depressurization space 105 is suctioned and the pressure in the depressurization space 105 is thus reduced, referring to FIGS. 2A and 2B, a sheet P positioned below the depressurization space 105 is suctioned and moves toward the lower surface 101X (see FIG. 2B) of the unit body 101.

Thus, the sheet P is attracted to the lower surface 101X, which is an exemplary attracting part. In other words, in the present exemplary embodiment, a sheet P is attracted to the lower surface 101X. More specifically, in the present exemplary embodiment, a sheet P is attracted to the lower surface 101X from below.

The lower surface 101X as an exemplary attracting part is flat. In the present exemplary embodiment, the attracting part has a planar shape, and a sheet P is attracted to the planar attracting part. In other words, in the present exemplary embodiment, a sheet P is attracted to an attracting surface.

Figure 2B:
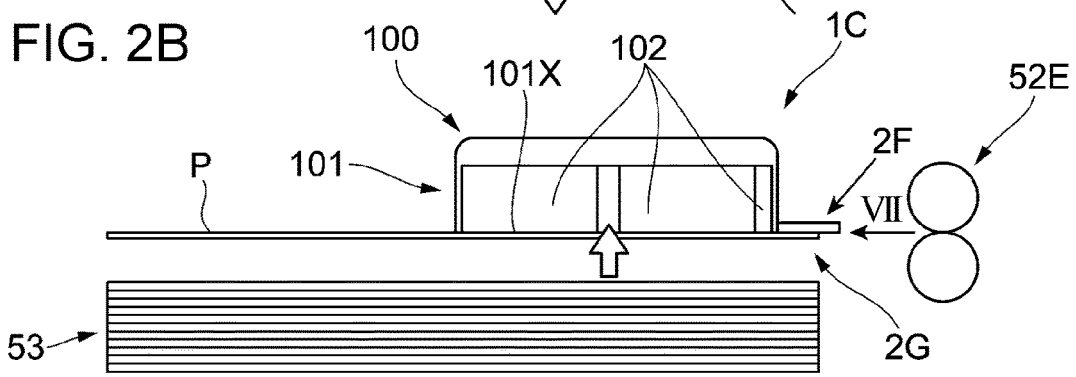

In the present exemplary embodiment, when a sheet P is attracted to the lower surface 101X of the unit body 101, the eight movable members 102 illustrated in FIG. 3 and positioned as illustrated in FIG. 2A move upward to be positioned as illustrated in FIG. 2B.

More specifically, in the present exemplary embodiment, a sheet P is attracted to the lower surface 101X illustrated in FIG. 3 as follows. The eight movable members 102 are pushed from below by the sheets P positioned therebelow and are thus moved upward. When the eight movable members 102 have been moved upward, a sheet P remains attracted to the lower surface 101X of the unit body 101.

In the present exemplary embodiment, while a sheet P is being attracted to the lower surface 101X, air is blown to an edge 2G of the sheet P attracted to the lower surface 101X. The air is blown from the upper side with respect to the lower surface 101X as represented by arrow 2F in FIG. 2B.

In other words, in the present exemplary embodiment, air is blown to the edge 2G from the upper side with respect to the edge 2G of the sheet P attracted to the lower surface 101X.

More specifically, in the present exemplary embodiment, the edge 2G illustrated in FIG. 2B is positioned at the leading end of the sheet P when the sheet P is transported (the edge 2G is hereinafter referred to as "leading-end edge 2G"), and air is blown to the leading-end edge 2G from the upper side.

While the present exemplary embodiment concerns a case where air is blown to the leading-end edge 2G, air may be blown from the upper side to any edge other than the leading-end edge 2G.

Figure 2C:
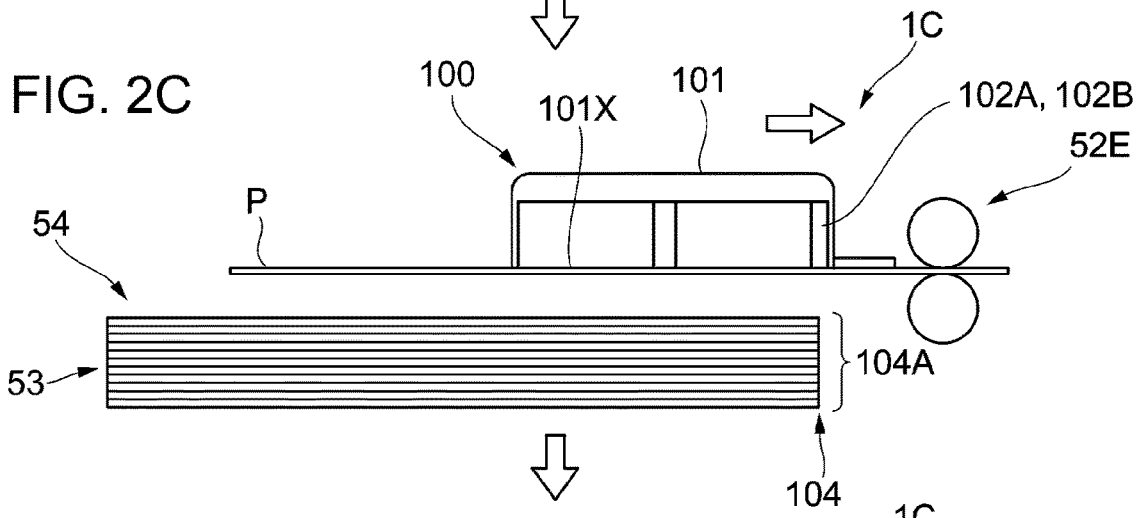

In the present exemplary embodiment, the suction unit 100 then moves toward the upstreammost transport roller 52E as illustrated in FIG. 2C, whereby the sheet P attracted to the lower surface 101X of the unit body 101 is supplied to the upstreammost transport roller 52E.

Hence, the upstreammost transport roller 52E starts to transport the sheet P.

In the present exemplary embodiment, the suction unit 100 moves in a direction intersecting the vertical direction and toward the upstreammost transport roller 52E.

Therefore, the sheet P attracted to the lower surface 101X of the unit body 101 is supplied to the upstreammost transport roller 52E. Hence, the upstreammost transport roller 52E starts to transport the sheet P.

In the present exemplary embodiment, as the suction unit 100 moves toward the upstreammost transport roller 52E as illustrated in FIG. 2C, the first leading-end movable member 102A and the second leading-end movable member 102B advance to the outside of a perimeter 104 of the sheet stack 54.

Specifically, in a top view of the suction unit 100 and the sheet stack 54 according to the present exemplary embodiment, the first leading-end movable member 102A and the second leading-end movable member 102B advance to the outside of the perimeter 104 of the sheet stack 54.

More specifically, in the present exemplary embodiment, the perimeter 104 of the sheet stack 54 includes a leading-end perimeter 104A as to be described below.

In the present exemplary embodiment, as the suction unit 100 moves toward the upstreammost transport roller 52E, the first leading-end movable member 102A and the second leading-end movable member 102B advance over the leading-end perimeter 104A as illustrated in FIG. 2C.

Figure 2D:
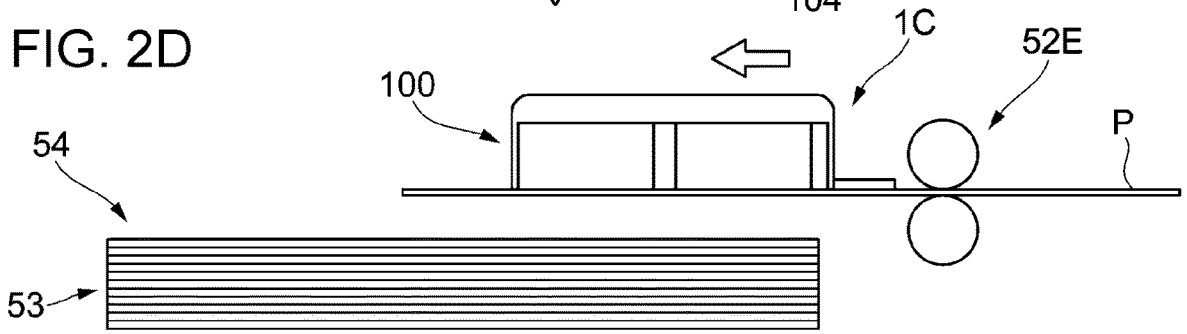

Subsequently, in the present exemplary embodiment, the suction unit 100 returns toward the sheet stack 54 as illustrated in FIG. 2D and is positioned above the sheet stack 54 again.

Figure 4:
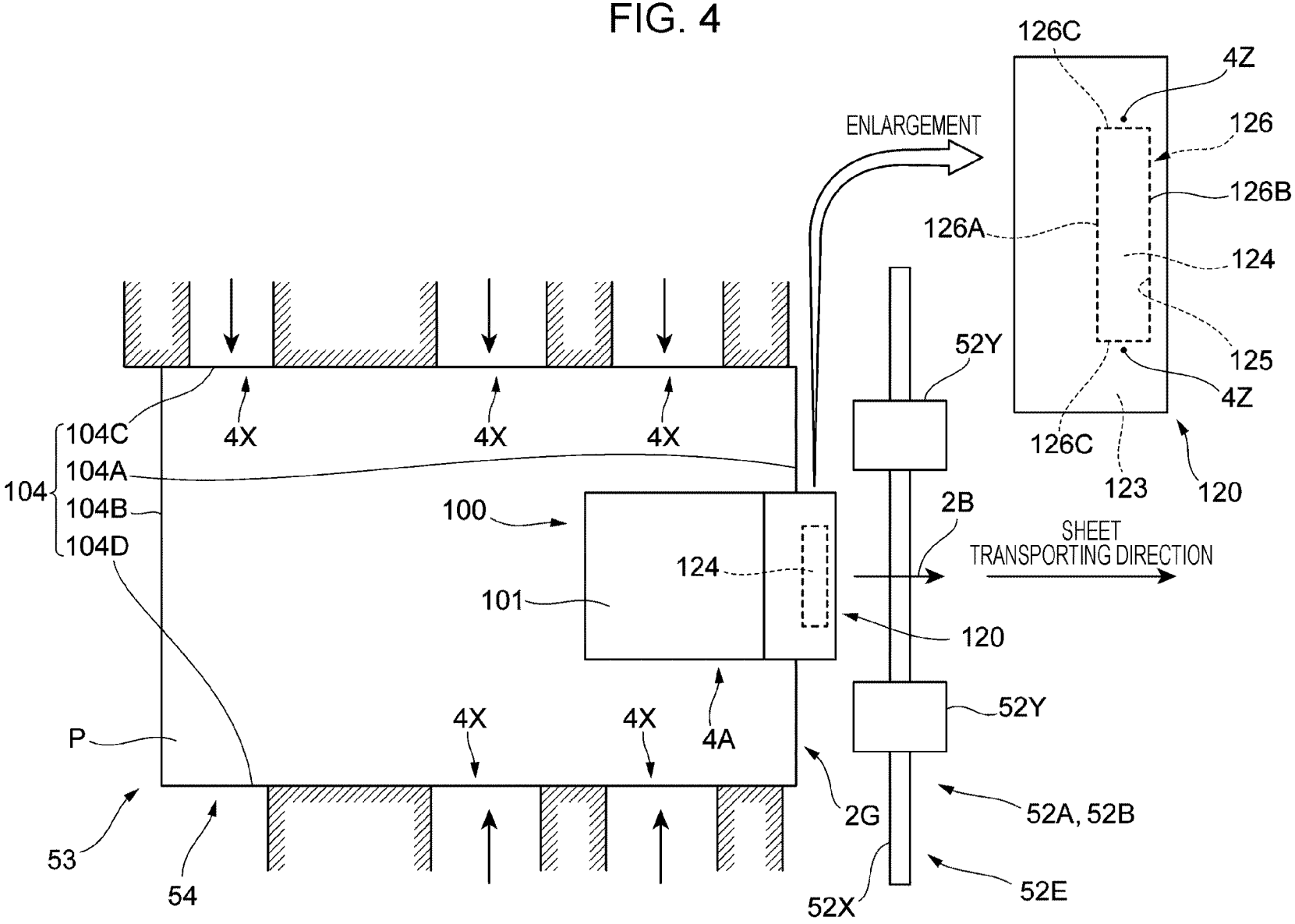
FIG. 4 illustrates a sheet stacking unit and relevant elements seen in a direction of arrow IV illustrated in FIG. 2A.

FIG. 4 illustrates the sheet stacking unit 53 and relevant elements seen in a direction of arrow IV illustrated in FIG. 2A. That is, FIG. 4 is a top view of the sheet stacking unit 53 and relevant elements.

As illustrated in FIG. 4, in the present exemplary embodiment, the sheet stack 54 including plural sheets P stacked in the thickness direction thereof is placed on the sheet stacking unit 53. The sheet stack 54 and the sheets P included in the sheet stack 54 each have the perimeter 104, which has a rectangular shape.

The rectangular perimeter 104 is formed of the leading-end perimeter 104A, a trailing-end perimeter 104B, a first side perimeter 104C, and a second side perimeter 104D.

The leading-end perimeter 104A is a part of the perimeter 104 that is positioned on the downstreammost side in the sheet transporting direction. The leading-end perimeter 104A extends in a direction intersecting (orthogonal to) the sheet transporting direction.

The trailing-end perimeter 104B is a part of the perimeter 104 that is positioned on the upstreammost side in the sheet transporting direction. The trailing-end perimeter 104B also extends in the direction intersecting (orthogonal to) the sheet transporting direction.

The first side perimeter 104C is a part of the perimeter 104 that connects one end of the leading-end perimeter 104A and one end of the trailing-end perimeter 104B. The first side perimeter 104C extends in the sheet transporting direction.

The second side perimeter 104D is a part of the perimeter 104 that connects the other end of the leading-end perimeter 104A and the other end of the trailing-end perimeter 104B. The second side perimeter 104D also extends in the sheet transporting direction.

To suction a sheet P, the unit body 101 of the suction unit 100 is positioned inside the perimeter 104 of the sheet stack 54 as denoted by reference numeral 4A in FIG. 4. Then, to supply the sheet P to the upstreammost transport roller 52E, the suction unit 100 moves toward the upstreammost transport roller 52E as represented by arrow 2B.

In this process according to the present exemplary embodiment, the first leading-end movable member 102A and the second leading-end movable member 102B (see FIG. 3) advance over the leading-end perimeter 104A of the sheet stack 54 as described above.

In the present exemplary embodiment, as illustrated in FIG. 4, plural openings 4X are provided on lateral sides of the sheet stack 54, and air is blown to the sheet stack 54 from the openings 4X. That is, air is also blown from lateral sides of the sheet stack 54.

In the present exemplary embodiment, the driving roller 52A and the follower roller 52B included in the upstreammost transport roller 52E each include a rotating shaft 52X and plural cylindrical members 52Y provided on the rotating shaft 52X.

In the present exemplary embodiment, when the suction unit 100 moves toward the upstreammost transport roller 52E, the suction unit 100 advances into a gap between adjacent two of the cylindrical members 52Y so that the suction unit 100 and the upstreammost transport roller 52E do not interfere with each other.

Referring to FIG. 3 again, the configuration of the suction unit 100 will further be described.

As described above, the suction unit 100 has the unit body 101. The unit body 101 is provided with an air guiding member 120 that guides air.

The air guiding member 120 has a rugged part 121 that makes the leading-end edge 2G (see FIG. 2B) of the sheet P wavy.

The rugged part 121 extends in the direction orthogonal to the sheet transporting direction. That is, the rugged part 121 extends along the leading-end edge 2G of the sheet P.

In the present exemplary embodiment, when the sheet P is attracted to the lower surface 101X of the unit body 101, the leading-end edge 2G of the sheet P is pressed against the rugged part 121 and is thus made to have a wavy shape.

The air guiding member 120 further has suction openings 122 positioned nearer to the lower surface 101X than the rugged part 121. The sheet P attracted to the lower surface 101X is further suctioned through the suction openings 122.

The air guiding member 120 further has an air guiding part 123 that guides the air to be blown to the leading-end edge 2G.

In the present exemplary embodiment, as to be described below, an air supply source such as a fan is provided at a position lower than the lower surface 101X serving as the attracting part. In the present exemplary embodiment, air is first supplied from the position lower than the lower surface 101X toward a position higher than the lower surface 101X.

In the present exemplary embodiment, the air thus supplied upward is guided by the air guiding part 123 to be redirected downward.

In the present exemplary embodiment, a single air guiding member 120 has both the rugged part 121 and the air guiding part 123. That is, in the present exemplary embodiment, the air guiding part 123 is included in the air guiding member 120 having the rugged part 121.

In other words, in the present exemplary embodiment, the rugged part 121 and the air guiding part 123 are both included in a single air guiding member 120.

The air guiding part 123 has a recess 124 that is concave upward.

Specifically, a lower surface 123A of the air guiding part 123 has the recess 124 that is concave upward. The recess 124 has a groove shape. As illustrated in FIG. 4, the recess 124 extends along the leading-end edge 2G of the sheet P.

More specifically, in the present exemplary embodiment as illustrated in FIG. 4, the lower surface 123A (see FIG. 3) of the air guiding part 123 has a rectangular opening 125, and a space above (vertically above) the opening 125 corresponds to the recess 124 that is concave upward as illustrated in FIG. 3.

In the present exemplary embodiment, as illustrated in FIG. 4, the perimeter of the opening 125 is defined by an opening edge 126. The opening edge 126 has a rectangular shape.

As illustrated in FIG. 4, the opening edge 126 includes a sheet-side opening edge 126A, an opposite-side opening edge 126B, and two connecting opening edges 126C.

The sheet-side opening edge 126A extends along the leading-end edge 2G of the sheet P.

The opposite-side opening edge 126B is positioned farther from the leading-end edge 2G of the sheet P than the sheet-side opening edge 126A. The opposite-side opening edge 126B also extends along the leading-end edge 2G of the sheet P.

One of the two connecting opening edges 126C connects one end of the sheet-side opening edge 126A and one end of the opposite-side opening edge 126B.

The other connecting opening edge 126C connects the other end of the sheet-side opening edge 126A and the other end of the opposite-side opening edge 126B.

Figure 5:
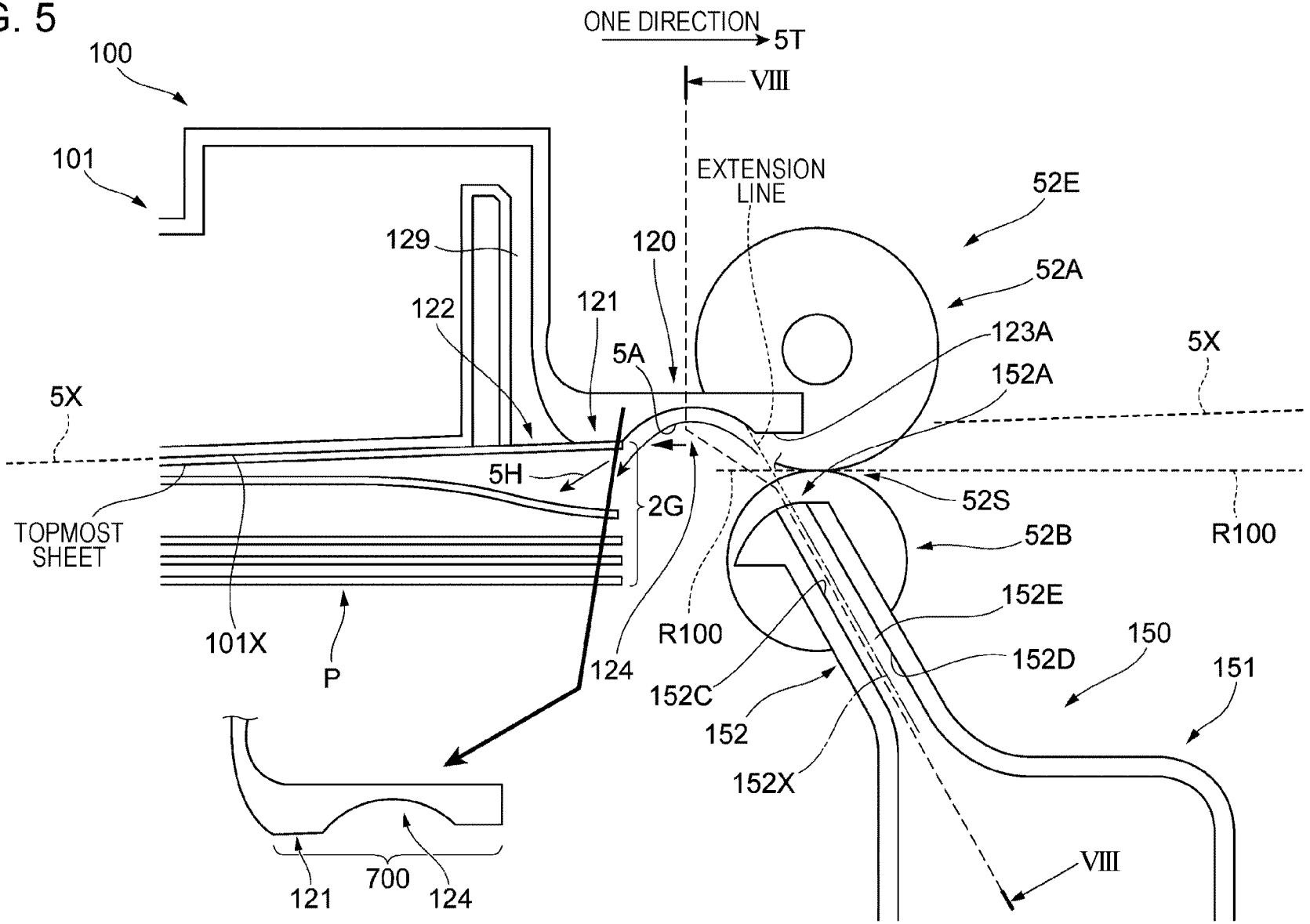
FIG. 5 is a sectional side view of the suction unit and relevant elements.

FIG. 5 is a sectional side view of the suction unit 100 and relevant elements.

In the present exemplary embodiment, although not described above, an air supply unit 150 that supplies air to be blown to the leading-end edge 2G is provided as illustrated in FIG. 5.

The air supply unit 150 includes an air supply source 151 such as a fan, and a tube 152 that guides the air sent from the air supply source 151 to flow obliquely upward.

The air supply source 151 and the tube 152 are positioned lower than the lower surface 101X of the unit body 101.

The tube 152 has a discharge port 152A at the tip thereof. The air to be blown toward the recess 124 provided in the air guiding member 120 is discharged from the discharge port 152A.

The tube 152 further has a first inner wall surface 152C and a second inner wall surface 152D that are opposite each other. The tube 152 further has a third inner wall surface 152E and a fourth inner wall surface (not illustrated) that each connect the first inner wall surface 152C and the second inner wall surface 152D. In the present exemplary embodiment, the first inner wall surface 152C is nearer to the sheet P than the second inner wall surface 152D.

In the present exemplary embodiment, as represented by arrow 5A, air flowing from the position lower than the lower surface 101X of the unit body 101 is first directed to a position higher than the lower surface 101X and is then redirected downward to be blown to the leading-end edge 2G from the position higher than the lower surface 101X.

In other words, in the present exemplary embodiment, air flowing from a position lower than an extension plane 5X, which is an extension of the lower surface 101X, is first directed toward the upper side with respect to the extension plane 5X and is then redirected toward the lower side with respect to the extension plane 5X to be blown to the leading-end edge 2G.

That is, in the present exemplary embodiment, air is first guided upward by the tube 152 and then guided downward. In the present exemplary embodiment, the air thus guided downward is blown to the leading-end edge 2G of the sheet P.

In the present exemplary embodiment, the lower surface 123A of the air guiding member 120 included in the sheet transporting device 1B (see FIG. 1) is used to cause the air flowing from the position lower than the lower surface 101X of the unit body 101 to be redirected downward. The air thus redirected downward is blown to the leading-end edge 2G of the sheet P.

In the present exemplary embodiment, the discharge port 152A is positioned lower than a contact part 52S defined between the driving roller 52A and the follower roller 52B included in the upstreammost transport roller 52E.

In the present exemplary embodiment, air flowing through the tube 152 is discharged from the discharge port 152A positioned at the tip of the tube 152, and the discharge port 152A is positioned lower than the contact part 52S defined between the driving roller 52A and the follower roller 52B.

In the present exemplary embodiment, the tube 152 that guides the air flowing upward does not cross a sheet transport path R100. Specifically, in the present exemplary embodiment, the discharge port 152A of the tube 152 is positioned lower than the sheet transport path R100.

Therefore, in the present exemplary embodiment, only air crosses the sheet transport path R100. More specifically, in the present exemplary embodiment, the tube 152 does not cross the sheet transport path R100 but only the air to be blown to the leading-end edge 2G crosses the sheet transport path R100.

In the present exemplary embodiment, the air having crossed the sheet transport path R100 flows toward the recess 124, and the recess 124 guides the air. The air thus guided is blown to the leading-end edge 2G.

In the present exemplary embodiment, the air blown from the upper side is directed obliquely downward to the leading-end edge 2G as represented by arrow 5H. Thus, the air directed obliquely downward is blown to the leading-end edge 2G.

Specifically, in the present exemplary embodiment, air is sent obliquely downward from a position higher than and away from the leading-end edge 2G of the sheet P attracted to the lower surface 101X and is thus blown to the leading-end edge 2G.

More specifically, in the present exemplary embodiment, air is sent obliquely downward and toward the leading-end edge 2G from a position farther from the lower surface 101X than the leading-end edge 2G of the topmost sheet P and higher than the lower surface 101X. In such a manner, the air is blown to the leading-end edge 2G of the sheet P attracted to the lower surface 101X.

Air that is sent obliquely downward as described above is more likely to flow into gaps between the sheets P as represented by arrow 5H than in a case where air is sent vertically downward.

In the present exemplary embodiment, each of the sheets P stacked on the sheet stacking unit 53 is transported as follows. First, as illustrated in FIGS. 2A and 2B, one sheet P is picked up by attracting the topmost sheet P in the sheet stack 54 to the suction unit 100.

In other words, a sheet P at the top of the sheet stack 54 is attracted to the suction unit 100, whereby one sheet P is picked up.

Subsequently, in the present exemplary embodiment, the suction unit 100 to which the sheet P is being attracted moves toward the upstreammost transport roller 52E, whereby the sheet P attracted to the suction unit 100 is supplied to the upstreammost transport roller 52E.

In the present exemplary embodiment, the suction unit 100 does not move up and down when picking up a sheet P (when the suction unit 100 suctions a sheet P). Alternatively, the suction unit 100 may be lowered to pick up a sheet P and be lifted up after the sheet P is attracted to the suction unit 100.

If, for example, the sheets P are sticking together with a large force, the second and subsequent sheets P that are present below the topmost sheet P attracted to the suction unit 100 may remain sticking to the topmost sheet P. In such a situation, plural sheets P may be supplied to the upstreammost transport roller 52E, which is so-called multiple feeding.

In the present exemplary embodiment, to suppress the occurrence of multiple feeding, air is blown to the leading-end edge 2G from the upper side as described above.

In the present exemplary embodiment, a combination of the air supply unit 150 and the air guiding member 120 serves as a blowing device, with which air is blown to the leading-end edge 2G from a position higher than the lower surface 101X of the unit body 101.

The situation where "air is blown to the leading-end edge 2G from a position higher than the lower surface 101X of the unit body 101" includes a situation where air is blown to the leading-end edge 2G from a position higher than the extension plane of the lower surface 101X of the unit body 101.

In the present exemplary embodiment, as illustrated in FIG. 4, air is also blown to the sheet stack 54 from the lateral sides of the sheet stack 54 so as to suppress the sticking between the sheets P.

If air is blown to the sheet stack 54 from the lateral sides of the sheet stack 54, the individual sheets P tend to float and move upward. Consequently, the second and subsequent sheets P are likely to stick to the topmost sheet P attracted to the suction unit 100.

In contrast, if air is blown from the upper side as in the present exemplary embodiment, the air tends to flow into the gap between the topmost sheet P and the second and subsequent sheets P.

The present exemplary embodiment concerns a case where air-blowing from the lateral sides and air-blowing from the upper side are performed simultaneously. Alternatively, for example, only air-blowing from the upper side may be performed while air-blowing from the lateral sides is not employed or is temporarily stopped.

In the present exemplary embodiment, the air supply unit 150 also supplies air while the suction unit 100 is moving toward the upstreammost transport roller 52E.

Specifically, in the present exemplary embodiment, the air supply unit 150 constantly supplies air. That is, the air supply unit 150 keeps supplying air while the suction unit 100 is moving.

Alternatively, while the suction unit 100 is moving toward the upstreammost transport roller 52E, the supply of air from the air supply unit 150 may be stopped or the volume of air supplied from the air supply unit 150 may be reduced.

The present exemplary embodiment will further be described. As illustrated in FIG. 5, the unit body 101 has a sheet meeting surface 700 on the downstream side with respect to the lower surface 101X, corresponding to an exemplary attracting part, in one direction. The sheet meeting surface 700 meets the sheet P.

Specifically, in the present exemplary embodiment, the sheet P attracted to the lower surface 101X is transported in the one direction represented by arrow 5T illustrated in FIG. 5; and the sheet meeting surface 700, which faces downward, is provided on the downstream side with respect to the lower surface 101X in the one direction.

In the present exemplary embodiment, the sheet P comes into contact with a part of the sheet meeting surface 700 facing downward. More specifically, in the present exemplary embodiment, the sheet meeting surface 700 has the rugged part 121 and the recess 124. The sheet P comes into contact with a part of the sheet meeting surface 700 where the rugged part 121 is formed (a part where a rugged surface is formed).

Furthermore, in the present exemplary embodiment, the above part of the sheet meeting surface 700 facing downward meets the sheet P attracted to the lower surface 101X. More specifically, the part of the sheet meeting surface 700 where the rugged part 121 is formed (the part where the rugged surface is formed) meets the sheet P.

In the present exemplary embodiment, the air supply unit 150, which corresponds to an exemplary air sending unit, is provided at a position lower than the lower surface 101X, and the air supply unit 150 sends air obliquely upward.

Furthermore, in the present exemplary embodiment, the sheet meeting surface 700 intersects an extension line along which the air supply unit 150 sends air.

Herein, the situation where the sheet meeting surface 700 intersects an extension line along which the air supply unit 150 sends air refers to a situation where the sheet meeting surface 700 intersects an extension line of a center axis 152X of the tube 152 that extends in the axial direction of the tube 152.

Figure 7:
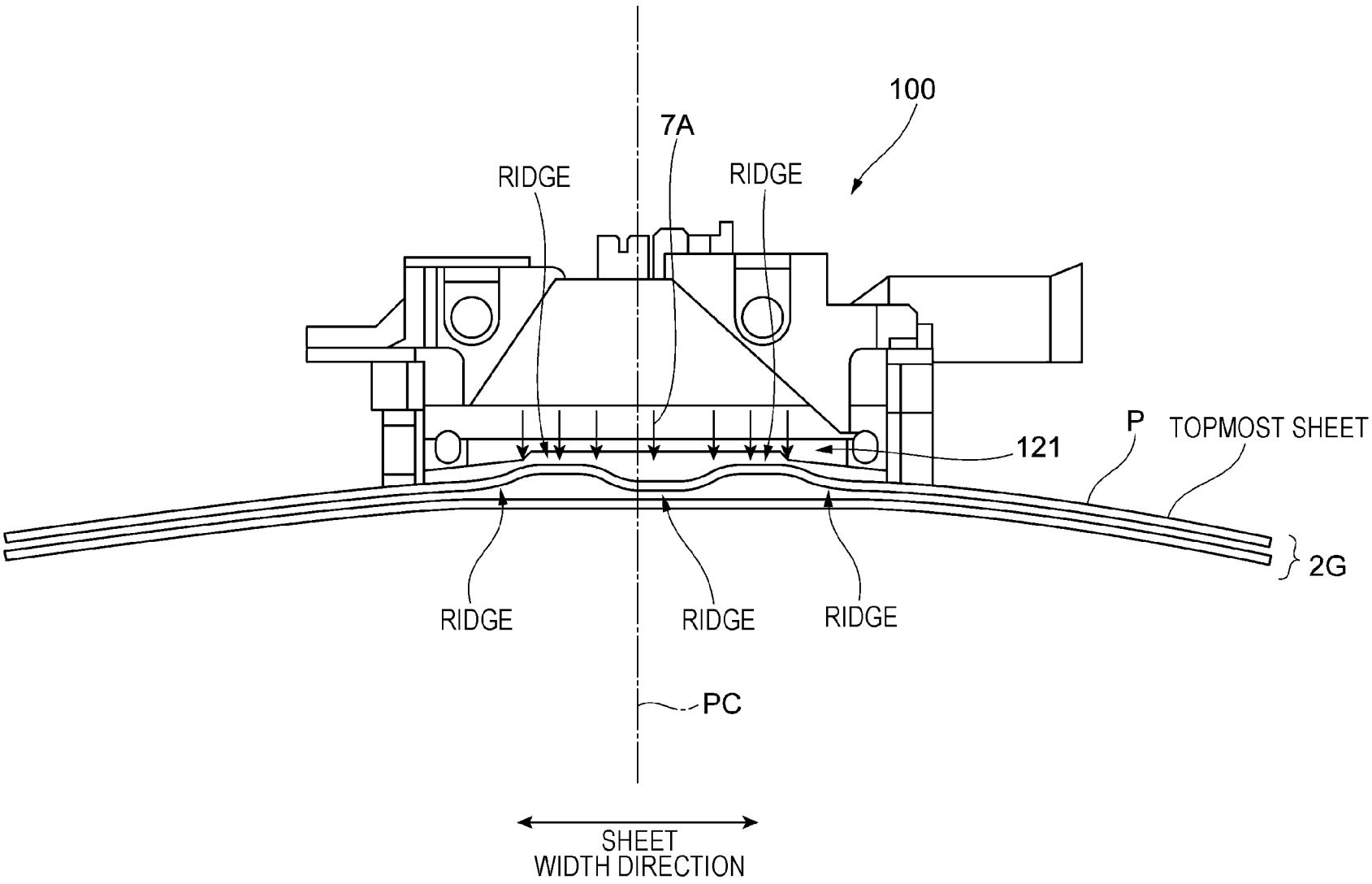
FIG. 7 illustrates the suction unit seen in a direction of arrow VII illustrated in FIG. 2B.

In the present exemplary embodiment, as illustrated in FIG. 7, when the rugged part (rugged surface) 121 is seen from the downstream side in the one direction, ridges are arranged in bilateral symmetry.

Specifically, with reference to a symmetry axis PC passing through the widthwise center of the sheet P and extending in the vertical direction, the rugged part (rugged surface) 121 according to the present exemplary embodiment is shaped in line symmetry.

The present exemplary embodiment described above concerns a case where, as illustrated in FIG. 3, a single air guiding member 120 has both the rugged part 121 and the air guiding part 123, and the air guiding member 120 is attached to the unit body 101, whereby the rugged part 121 and the air guiding part 123 are integrated with the unit body 101.

Alternatively, the air guiding member 120 may be provided separately from the unit body 101. That is, the air guiding member 120 may be separate from the unit body 101.

Moreover, the air guiding part 123 may be provided separately from the rugged part 121. That is, the air guiding part 123 may be separate from the unit body 101 and from the rugged part 121.

Referring to FIG. 5, the air guiding member 120 will further be described.

As illustrated in FIG. 5, the air guiding member 120 has the suction openings 122 positioned nearer to the lower surface 101X than the rugged part 121. The sheet P attracted to the lower surface 101X is further suctioned through the suction openings 122.

In the present exemplary embodiment, after the sheet P is attracted to the lower surface 101X, suction of the sheet P through the suction openings 122 is started.

In the present exemplary embodiment, as illustrated in FIG. 5, the suction openings 122 are connected to the inside of the unit body 101 through a connecting path 129. The inside of the connecting path 129 is to be depressurized. Referring to FIG. 3, the width (the size in the direction in which the leading-end edge 2G extends) of the connecting path 129 gradually increases toward the lower side.

In the present exemplary embodiment, before the sheet P is attracted to the lower surface 101X, there is a gap between the sheet P and the suction openings 122. Therefore, suction of the sheet P through the suction openings 122 is disabled.

When the sheet P is attracted to the lower surface 101X, the gap between the sheet P and the suction openings 122 is eliminated, and the sheet P is suctioned through the suction openings 122.

When the sheet P is suctioned through the suction openings 122, the leading-end edge 2G of the sheet P is urged and pressed against the rugged part 121. Thus, the leading-end edge 2G comes to have a rugged shape. In other words, the leading-end edge 2G comes to have a wavy shape (as to be described below).

Figure 6:
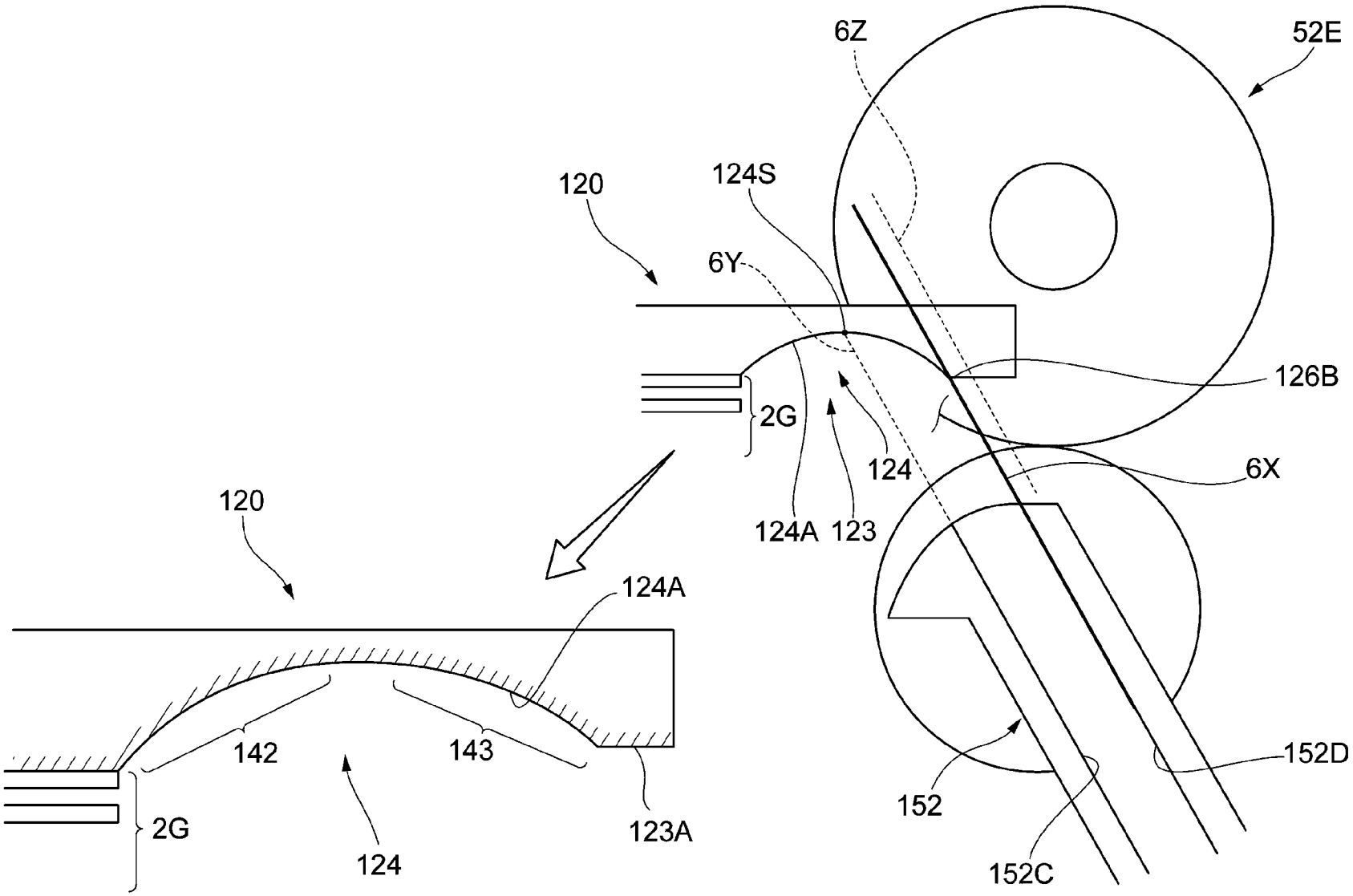
FIG. 6 illustrates a recess.

FIG. 6 illustrates the recess 124.

In the present exemplary embodiment, as described above, the air guiding part 123 has the recess 124 that is concave upward. As described above, the recess 124 has a groove shape extending along the leading-end edge 2G of the sheet P.

In the present exemplary embodiment, air is guided by an inner surface 124A of the recess 124 and is thus blown to the leading-end edge 2G.

The inner surface 124A of the recess 124 is concave upward and is curved to form an arc in sectional view.

Specifically, in the present exemplary embodiment, a section of the inner surface 124A of the recess 124 that is taken along a plane orthogonal to the direction in which the leading-end edge 2G extends is concave upward and is curved to form an arc shape.

In the present exemplary embodiment, as illustrated in FIG. 6, the sectional shape of the inner surface 124A of the recess 124 forms a part of a line that defines an ellipse. Alternatively, the sectional shape of the inner surface 124A may form a part of a line that defines a perfect circle, or the inner surface 124A may have a V shape as to be described below.

In the present exemplary embodiment, the inner surface 124A of the recess 124 includes a slope 142 descending from a side farther from the leading-end edge 2G of the sheet P toward a side nearer to the leading-end edge 2G.

Specifically, in the present exemplary embodiment, the inner surface 124A of the recess 124 includes the slope 142 descending from a position outside and away from the perimeter 104 (see FIG. 4) of the topmost sheet P toward the perimeter 104.

In short, in the present exemplary embodiment, a part of the lower surface 123A of the air guiding member 120 has the slope 142 descending while extending toward the perimeter 104.

In the present exemplary embodiment, air is guided downward by the slope 142 and is thus blown to the leading-end edge 2G.

Furthermore, in the present exemplary embodiment, as illustrated in FIG. 6, another part of the inner surface 124A of the recess 124 serves as a guiding part 143.

The guiding part 143 is provided across to the slope 142 from the leading-end edge 2G. In other words, the guiding part 143 is positioned farther from the leading-end edge 2G than the slope 142.

The air having reached a position higher than the lower surface 101X of the unit body 101 is guided by the guiding part 143 toward the slope 142. In other words, the air sent from below the guiding part 143 is guided by the guiding part 143 toward the slope 142.

The guiding part 143 ascends while extending toward the slope 142. The ascending of the guiding part 143 is utilized in guiding the air coming from below toward the slope 142.

In the present exemplary embodiment, a virtual plane in which the second inner wall surface 152D of the tube 152 extends is denoted as "second virtual plane 6X", and the second virtual plane 6X passes through the opposite-side opening edge 126B.

Alternatively, the second inner wall surface 152D may be set such that the second virtual plane 6X passes through a point between the opposite-side opening edge 126B and a bottom 124S (the deepest point of the inner surface 124A) of the recess 124.

Furthermore, in the present exemplary embodiment, a virtual plane in which the first inner wall surface 152C of the tube 152 extends is denoted as "first virtual plane 6Y", and the first virtual plane 6Y passes through the bottom 124S of the recess 124.

Alternatively, the first inner wall surface 152C may be set such that the first virtual plane 6Y passes through a point between the bottom 124S and the opposite-side opening edge 126B and on a side nearer to the bottom 124S than the second virtual plane 6X.

FIG. 7 illustrates the suction unit 100 seen in a direction of arrow VII illustrated in FIG. 2B.

In the present exemplary embodiment, as represented by arrows 7A, air is blown toward the leading-end edge 2G from the upper side of the leading-end edge 2G. Specifically, the air is blown to a part of the leading-end edge 2G that has the wavy shape.

More specifically, in the present exemplary embodiment, the leading-end edge 2G of the sheet P is pressed against the rugged part 121 and thus comes to have a wavy shape.

In the present exemplary embodiment, the air is blown to the wavy-shaped part from the upper side.

Therefore, compared with a case where air is blown to a part of the sheet P that does not have a wavy shape, air is more likely to flow into the gap between the topmost sheet P attracted to the suction unit 100 and the second and subsequent sheets P sticking to the topmost sheet P.

Herein, the term "wavy shape" refers to a shape in which first ridges each projecting from one side of the sheet P toward the other side in the thickness direction of the sheet P and second ridges each projecting from the other side of the sheet P toward the one side in the thickness direction of the sheet P are positioned alternately in the direction in which the leading-end edge 2G extends.

The numbers of first ridges and second ridges are not specifically limited. A shape formed of one first ridge and one second ridge that are positioned side by side is also regarded as a wavy shape.

Figure 8:
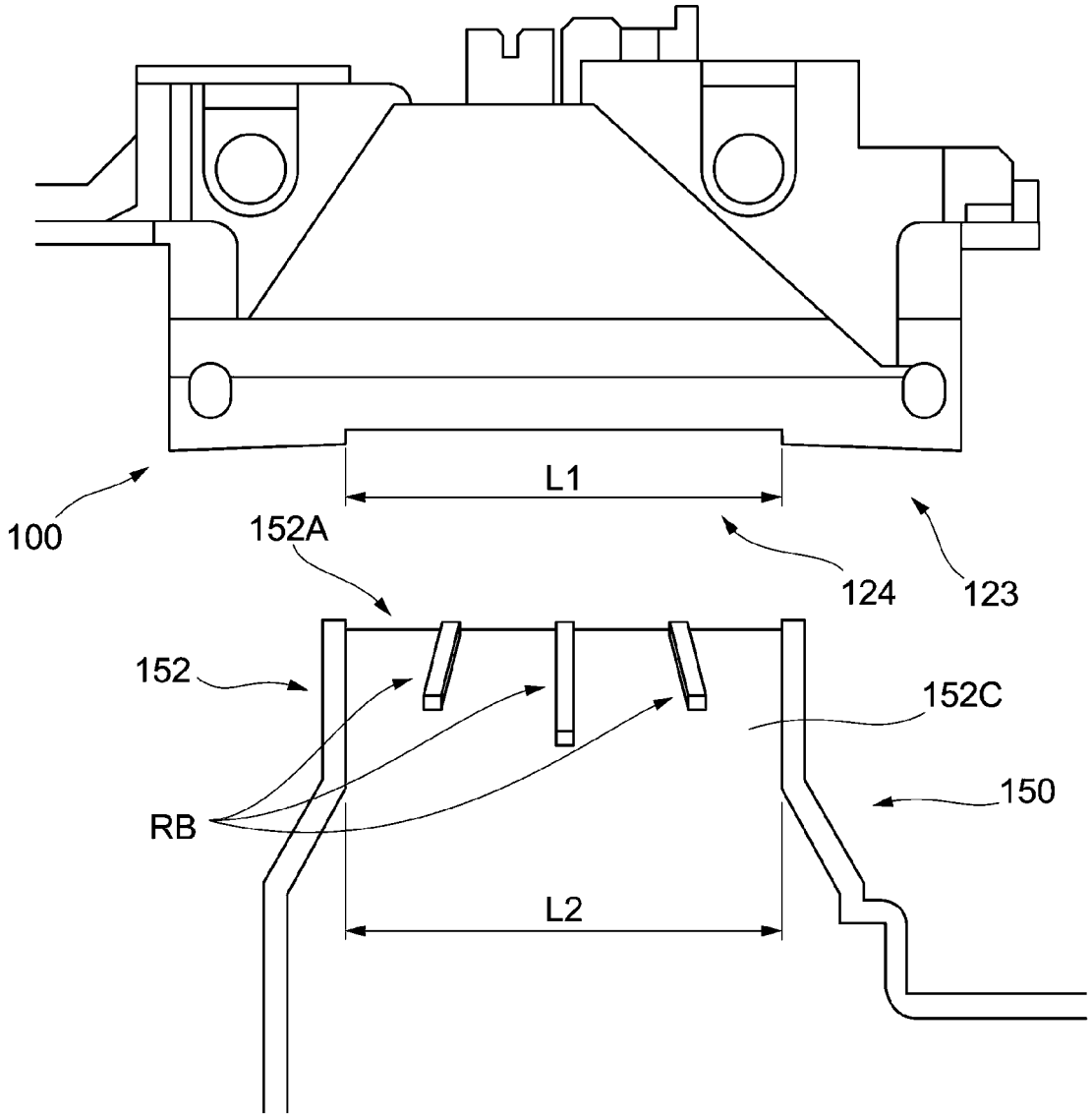
FIG. 8 is a sectional view of the suction unit and an air supply unit taken along line VIII-VIII illustrated in FIG. 5.

FIG. 8 is a sectional view of the suction unit 100 and the air supply unit 150 taken along line VIII-VIII illustrated in FIG. 5.

In the present exemplary embodiment, a width L1 of the recess 124 provided in the air guiding part 123 is equal to a width L2 of the discharge port 152A provided at the tip of the tube 152.

Specifically, comparing as a length in the direction in which the leading-end edge 2G (see FIG. 4) extends, the width L1 of the recess 124 provided in the air guiding part 123 is equal to the width L2 of the discharge port 152A provided at the tip of the tube 152.

The present exemplary embodiment concerns a case where the width L1 of the recess 124 provided in the air guiding part 123 is equal to the width L2 of the discharge port 152A provided at the tip of the tube 152. Alternatively, the width L1 of the recess 124 provided in the air guiding part 123 may be greater than the width L2 of the discharge port 152 provided at the tip of the tube 152.

In the present exemplary embodiment, the first inner wall surface 152C has three ribs RB each extending in the direction of the airflow.

Two of the three ribs RB that are on two respective outer sides are each inclined toward the widthwise center of the recess 124 while extending toward the downstream side in the direction of the airflow.

Figure 9B:
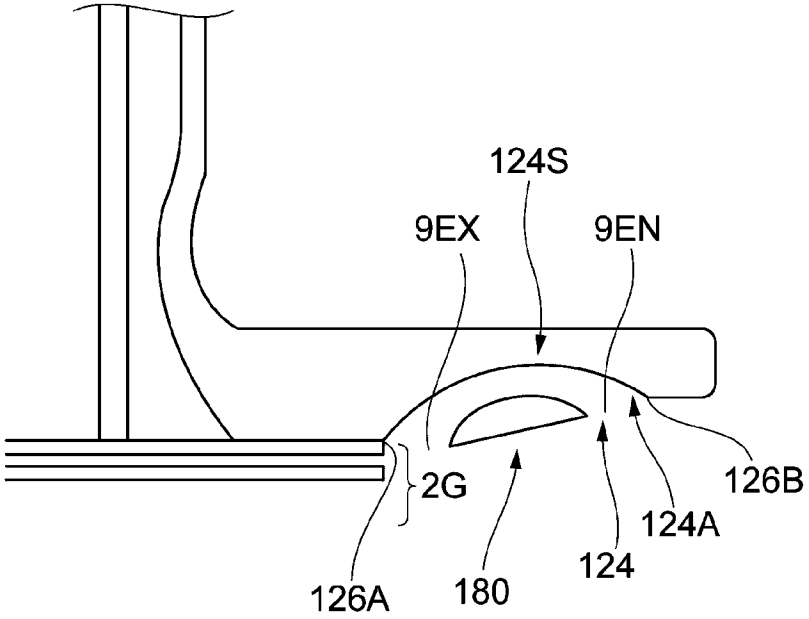
FIGS. 9A and 9B illustrate other configurations of the recess.
Figure 9A:
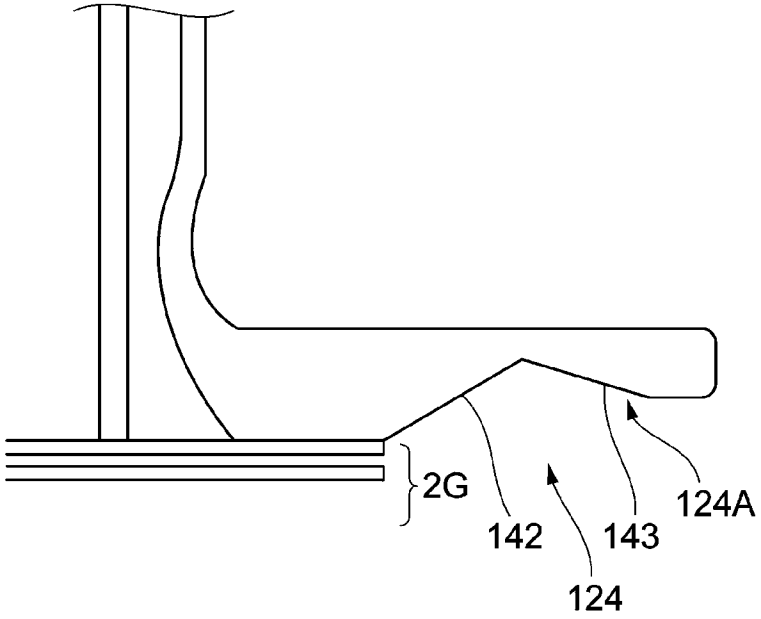

FIGS. 9A and 9B illustrate other configurations of the recess 124.

The above description concerns a case where the inner surface 124A is curved. Alternatively, as illustrated in FIG. 9A, the inner surface 124A of the recess 124 may have a V shape.

In the configuration illustrated in FIG. 9A, the inner surface 124A of the recess 124 includes, as with the above exemplary embodiment, a slope 142 descending while extending toward the leading-end edge 2G. The slope 142 is not curved but is flat.

In such a configuration, as with the above exemplary embodiment, a guiding part 143 that guides air toward the slope 142 is provided across the slope 142 from the leading-end edge 2G.

The guiding part 143 ascends while extending toward the leading-end edge 2G. The guiding part 143 is not curved but is flat.

In a configuration illustrated in FIG. 9B, a counter member 180 is provided in such a manner as to face the inner surface 124A of the recess 124. The counter member 180 extends along the leading-end edge 2G.

The counter member 180 is fixed at positions 4Z denoted in FIG. 4. Specifically, the counter member 180 is fixed to the air guiding part 123 at two ends of the recess 124.

As illustrated in FIG. 9B, the counter member 180 is spaced apart from the inner surface 124A and is positioned in such a manner as to face the bottom 124S of the recess 124.

Furthermore, the counter member 180 is positioned between the sheet-side opening edge 126A and the opposite-side opening edge 126B.

In this configuration, a space between the opposite-side opening edge 126B and the counter member 180 serves as an air inlet 9EN, and a space between the sheet-side opening edge 126A and the counter member 180 serves as an air outlet 9EX.

In this configuration, air supplied from the air supply unit 150 (not illustrated in FIG. 9B) flows through the inlet 9EN toward the inner surface 124A and is guided by the inner surface 124A to the outlet 9EX. Then, the air exits from the outlet EX and is blown to the leading-end edge 2G.

Other Exemplary Embodiments

The above description concerns a case where the sheet P is moved toward the upstreammost transport roller 52E by moving the suction unit 100. Alternatively, as illustrated in FIG. 10 (illustrating another configuration of the sheet feeding section 1C), the sheet P may be moved toward the upstreammost transport roller 52E without moving the suction unit 100.

Figure 10:
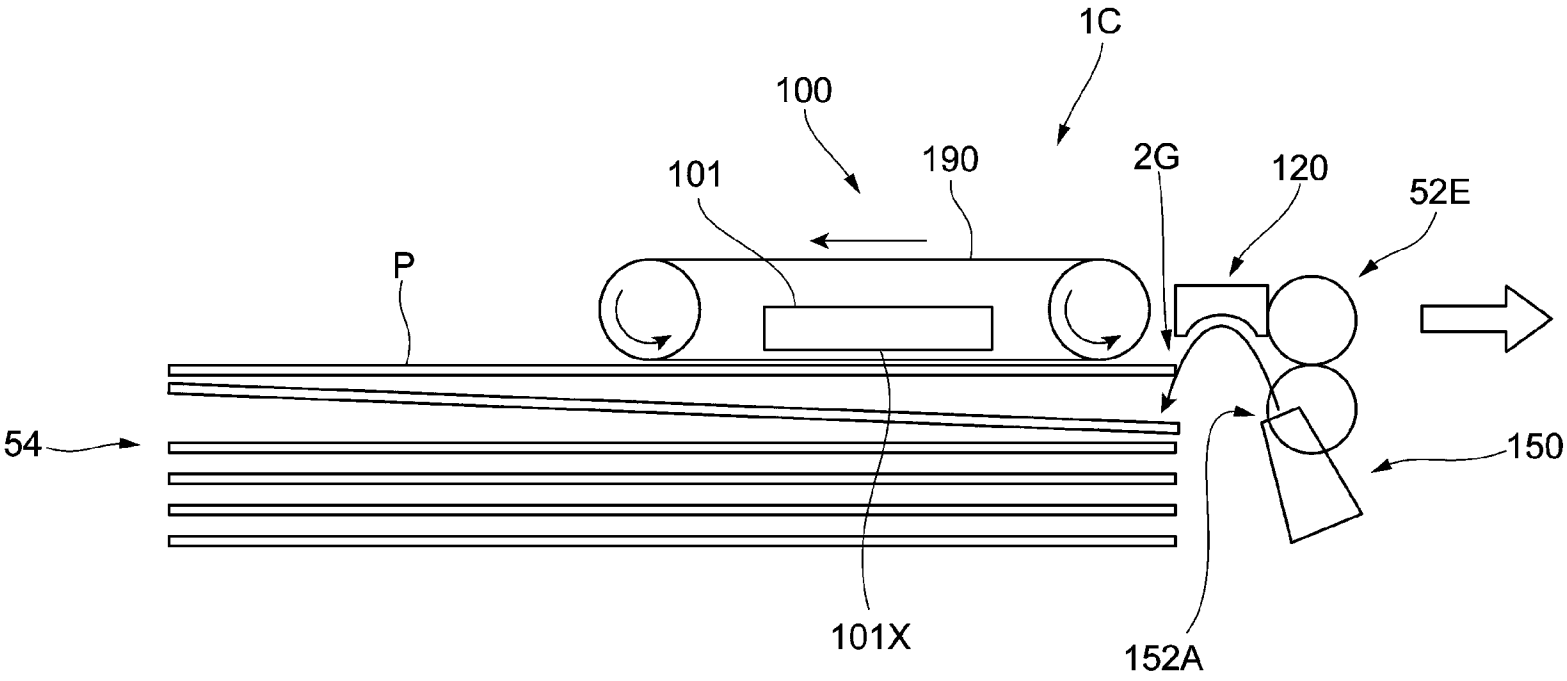
FIG. 10 illustrates another configuration of the sheet feeding section.

In the configuration illustrated in FIG. 10, the suction unit 100 includes a unit body 101 having a lower surface 101X, and a belt member 190 that is rotatable.

The unit body 101 is provided on the inner side of the belt member 190. The belt member 190 has plural through-holes (not illustrated) through each of which the inner side and the outer side of the belt member 190 communicate with each other.

In this configuration, when a sheet P is suctioned by the unit body 101, the sheet P is attracted to the outer peripheral surface of the belt member 190. In this configuration, a part of the outer peripheral surface of the belt member 190 that faces downward serves as the attracting part to which the sheet P is attracted. The attracting part in this configuration has a flat shape.

When a sheet P is attracted to the outer peripheral surface of the belt member 190, air is blown to the leading-end edge 2G of the sheet P, as with the above exemplary embodiment. Then, the belt member 190 starts to rotate. Thus, the sheet P is supplied to the upstreammost transport roller 52E.

In this configuration, the belt member 190 starts to rotate after the air-blowing to the leading-end edge 2G is stopped or the volume of the air blown to the leading-end edge 2G is reduced.

This configuration does not include any functional part, such as the air guiding member 120 illustrated in FIG. 5, for supporting the leading-end edge 2G from the upper side. Therefore, when the sheet P passes over the discharge port 152A (see FIG. 10), the sheet P tends to flap by receiving the air blown thereto.

Accordingly, in this configuration, while the sheet P is being moved toward the upstreammost transport roller 52E, the air-blowing is stopped or the volume of air to be blown is reduced.

Alternatively, air may be blown directly to the leading-end edge 2G from above.

Specifically, the exemplary embodiment described above concerns a case where air from the air supply source 151 positioned lower than the leading-end edge 2G is blown to the leading-end edge 2G from above by directing the air from the air supply source 151 temporarily upward and then downward. The method of air-blowing is not limited thereto.

For example, air may be supplied directly to the leading-end edge 2G from above by providing an air supply source such as a fan at a position higher than the lower surface 101X of the unit body 101. In such a case, the recess 124 may be omitted.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A recording-material-transporting device comprising:

an attracting part to which a recording material is attracted from below; and a blowing device that blows air from a position higher than the attracting part to an edge of the recording material attracted to the attracting part, wherein the blowing device comprises a rugged part again which the material attracted to the attracting part is pressed such that the edge of the recording material is made to have a wavy shape.

2. The recording-material-transporting device according to claim 1, wherein the blowing device blows air to the edge by sending air obliquely downward from the position higher than the attracting part, the position being away from the edge.

3. The recording-material-transporting device according to claim 1, wherein the air to be blown to the edge from the position higher than the attracting part is first directed upward from a position lower than the attracting part to the position higher than the attracting part and is redirected downward.

4. The recording-material-transporting device according to claim 3, wherein the blowing device comprises an air guiding part that guides the air directed to the position higher than the attracting part, wherein the air directed upward is guided downward by the air guiding part.

5. The recording-material-transporting device according to claim 4, wherein the air guiding part is included in a member of the blowing device having the rugged part.

6. The recording-material-transporting device according to claim 4, wherein a lower surface of a member included in the blowing device is used in causing the air directed upward to the position higher than the attracting part to be guided downward.

7. The recording-material-transporting device according to claim 6, wherein the lower surface includes a slope descending from a side farther from the edge of the recording material toward a side nearer to the edge such that the air directed downward flows toward the edge.

8. The recording-material-transporting device according to claim 7, wherein the lower surface includes a guiding part on a side farther from the edge than the slope, and wherein the air directed to the position higher than the attracting part is guided by the guiding part toward the slope.

9. The recording-material-transporting device according to claim 1, wherein the air from the position higher than the attracting part is blown to a wavy part of the edge.

10. An image forming apparatus comprising:

an image forming device that forms an image on a recording material; and the recording-material-transporting device according to claim 1.

11. A recording-material-transporting device comprising:

an attracting part to which a recording material is attracted from below; and a blowing device that blows air from a position higher than the attracting part to an edge of the recording material attracted to the attracting part, wherein the blowing device comprises an air guiding part that guides the air directed to the position higher than the attracting part, wherein the air guiding part has a recess that is concave upward, and wherein the air directed upward to the position higher than the attracting part is guided by an inner surface of the recess in such a manner as to be blown downward to the edge.

12. The recording-material-transporting device according to claim 11, wherein the inner surface of the recess is concave upward and is curved in such a manner as to form an arc in sectional view.

13. The recording-material-transporting device according to claim 11, further comprising:

a counter member that faces the inner surface of the recess while being spaced apart from the inner surface.

14. The recording-material-transporting device according to claim 11, further comprising:

a discharge port from which the air to be directed toward the recess of the air guiding part is discharged, wherein a width of the recess in a direction in which the edge extends is greater than or equal to a width of the discharge port in the direction in which the edge extends.

15. A recording-material-transporting device comprising:

an attracting part to which a recording material is attracted from below; and a blowing device that blows air to an edge of the recording material attracted to the attracting part, the air being blown from a position higher than the edge, wherein the blowing device comprises an air guiding part that guides the air directed to the position higher than the attracting part, and the air guiding part has a recess that is concave upward.

16. The recording-material-transporting device according to claim 15, further comprising:

a recording-material-meeting surface positioned on a downstream side with respect to the attracting part in a transport direction of the recording material and facing downward such that a part of the recording-material-meeting surface meets the recording material attracted to the attracting part; and an air sending unit provided at a position lower than the attracting part, wherein the recording-material-meeting surface include a rugged surface, and wherein the recording-material-meeting surface intersects an extension line extending in a direction in which the air sending unit sends air.

17. The recording-material-transporting device according to claim 16, wherein the rugged surface includes ridges that are arranged in bilateral symmetry when seen from the downstream side in the transport direction of the recording material.

* * * * *